United States Patent [19]

Houck

[11] 4,395,279

[45] Jul. 26, 1983

[54] PLASMA SPRAY POWDER

[75] Inventor: David L. Houck, Towanda, Pa.

[73] Assignee: Gte Products Corporation, Stamford, Conn.

[21] Appl. No.: 325,267

[22] Filed: Nov. 27, 1981

[51] Int. Cl.[3] ..... B22F 1/00

[52] U.S. Cl. ..... 75/0.5 BB; 75/0.5 BC; 75/251; 427/34; 427/423

[58] Field of Search ..... 75/0.5 BB, 0.5 BC, 251–255; 428/570; 419/31, 32, 35; 427/34, 423

[56] References Cited

U.S. PATENT DOCUMENTS

| | | | |
|---|---|---|---|
| 3,211,386 | 10/1965 | Frehn | 75/0.5 BC |
| 3,515,540 | 6/1970 | Meadows | 75/0.5 BC |
| 3,698,055 | 10/1972 | Holtz, Jr. | 75/0.5 BC |
| 3,936,295 | 2/1976 | Cromwell et al. | 427/34 |
| 4,025,334 | 5/1977 | Cheney et al. | 75/252 |
| 4,075,371 | 2/1978 | Patel | 427/423 |
| 4,275,124 | 6/1981 | McComas | 427/423 |

*Primary Examiner*—Michael L. Lewis

*Attorney, Agent, or Firm*—Robert E. Walter

[57] ABSTRACT

A plasma spray powder having a substantially uniform composition consisting essentially of a metal selected from the group consisting of cobalt, nickel, iron, mixtures and alloys thereof the balance consisting essentially of tungsten and carbon in a ratio of about one mole of carbon per one mole of tungsten wherein the ratio of iron and nickel to cobalt is at least about 4 to one.

6 Claims, No Drawings

PLASMA SPRAY POWDER

BACKGROUND OF INVENTION

This invention relates to a powder for plasma spray applications.

These powders require various agglomerations methods to make free flowing powders from normally nonflowing small particles. One such agglomeration method is spray drying. Agglomerates are formed in spray drying by atomizing a slurry of powder, binder and liquid into a drying chamber where the liquid is evaporated. The result is a generally spherical agglomerate held together by the binder. U.S. Pat. No. 3,617,358 describes an agglomeration process using an organic binder.

Other agglomeration processes have been developed to overcome what may be undesirable effects caused by the presence of organic binders. In some cases, the organic binder may cause fouling of the plasma gun due to vaporization of the organic. The presence of organics may even decrease the apparent density of the powder or affect the flame spray coating. In U.S. Pat. No. 3,881,911 to Cheney et al., the agglomerates are presintered to remove the binder. U.S. Pat. No. 3,973,948 to Laferty et al uses a water soluble ammonia complex as a binder and U.S. Pat. No. 4,025,334 to Cheney et al. uses an aqueous nitrate solution.

Because of their relatively large size and low surface area as compared with the original small particles which are often irregular in shape, the agglomerates have improved flow properties. However, the increased particle size and lower density resulting from agglomeration can be a disadvantage. Hence, plasma densification may be employed to produce spherical, dense, and homogeneous particles. According to this process, the agglomerated powder is entrained in a carrier gas and fed through a high temperature plasma reactor to melt the agglomerated particles. The melted particles are cooled to avoid coalescence so as to produce spherical dense particles. The use of the dense particle in flame spray applications can result in a dense, smooth coating which requires little or no finishing by grinding or machining as compared to coatings produced from the agglomerated particles. Further, the densified particles have improved flow characteristics which allow the use of a reduced volume of material leading to decreased processing time and improved efficiencies in plasma spraying. U.S. Pat. Nos. 3,909,241 and 3,974,245, both to Cheney et al., relate to such densification processes and the powders produced therefrom.

Tungsten carbide-cobalt powders are commonly used for hard surfacing as well as other applications. As a result of the potentially low availability and high cost of cobalt in relation to the demand, a need for substitutes exists.

SUMMARY OF THE INVENTION

In accordance with the present invention, there is provided a plasma spray powder consisting essentially of a metal selected from the group consisting of nickel, iron, cobalt, or mixtures and alloys thereof, with the balance being from about 50 to about 90 percent by weight tungsten and carbon, said tungsten and carbon being present in a one to one molar ratio and said nickel, iron, or mixture or alloy thereof, being present in a weight ratio of at least about 4 parts by weight to about one part by weight cobalt.

The resulting powders comprising tungsten carbide with iron or nickel substituted for at least a portion of the cobalt may be used as substitutes for powders consisting essentially of cobalt and tungsten carbide for many applications.

DETAILED DESCRIPTION

The powders of the present invention include iron or nickel as a substitute for at least a portion of cobalt. The weight ratio of cobalt to the nickel and iron combined is less than about 1 to about 4.

In some applications, nickel and iron may be a combined substitute. Since cobalt imparts the desirable properties of high temperature strength and oxidation resistance to the final coating, it is desirable to use a small proportion of cobalt in applications above 700° F. However, for low temperature applications the need for cobalt may be totally eliminated.

Due to the method of preparing the plasma spray powder of the present invention the powder particles may be dense. Although the individual particles may have compositions that vary from particle to particle, the overall composition of the powder is substantially uniform. The plasma densification of the particles preferably results in a prealloying of individual agglomerates to produce substantially homogeneous composite particles.

The plasma spray powder may be produced in two particle size ranges depending upon the desired final application technique. As a coarse powder the majority of the particles are within a −200+325 U.S. standard sieve particle size range.

As a fine plasma spray powder, it has a particle size distribution wherein at least 70 percent of the particles have a size less than 20 microns. Substantially all the particles pass through a 270 U.S. screen mesh. A typical particle size distribution has less than 10 percent of the particles below about 10 microns. The bulk density is from about 6 to about 7 grams/cc. Preferably, for the coarse powder distribution the Hall flow is within the range of from about 9 to 21 seconds/50 g. Powder with the fine particle size distribution does not flow.

In preparing the plasma spray powder of the present invention, a powder blend is prepared consisting essentially of the weight percent of components to give the desired final alloy powder composition. The powders are mixed by methods known in the art, such as by a blender, tumbler, or even, if size reduction is desired, by milling to obtain a suitable particle size. Preferably the overall powder blend has an average particle size less than about 10 microns.

The uniform power blend is next agglomerated by methods known in the art. For example, powder compacts can be formed and then crushed and screened to yield the desired particle size. Alternatively the powders can be mixed with a binder in the presence of moisture. However, agglomeration by spray drying is in general preferred for its flexibility and economy of operation on a production scale. The particular conditions under which the slurries are formed and spray dried are well known. U.S. Pat. No. 3,617,358, issued Nov. 2, 1971 describes formation of slurries. Other suitable methods for agglomerating are described in U.S. Pat. Nos. 3,881,911, 3,973,948 and 4,025,734 hereinafter discussed. The use of spray drying results in a close control over the size of the agglomerates. The blending technique results in a uniform mixture of the ingredients.

An alternative method of preparing the agglomerated particles is in a fluidized bed, such as a Glatt fluidized bed granulator. According to this method, a fine spray of liquid and soluble binder is introduced into the fluidized mixture of powders. One example of a liquid and binder system is water and polyethylene glycol. The gases passing through the fluidized bed which maintain the powders to be agglomerated in suspension are heated such that the liquids in the spray are evaporated. The fine particles in the fluidized bed then become bound together as larger agglomerates with the binder which remains after the evaporation.

The agglomerates may be conveniently classified to obtain a desired particle size distribution, for example it is generally desired to have at least 80% of the particles within a range of 50 micron average particle size.

The classified agglomerates are passed through a furnace at low temperatures to decompose the binders used for agglomeration and further treated at high temperatures to strengthen them for subsequent handling.

The sintered agglomerates can be subsequently screened to yield a particle size distribution suitable for creating plasma sprayed coatings. Typically these distributions fall within two ranges, −200 +325 mesh or −270 mesh. The coarser distribution powder typically contains 10% +200 and 10% −325 material. The finer distribution powder generally has a restriction on the percentage of ultra fine particles allowable, e.g. a maximum of 20% −20 μm.

Alternatively, the agglomerated and sintered particles can also be subsequently plasma densified so as to produce fine, spherical, densified particles. The densification process comprises entraining agglomerated powders in a carrier gas and feeding the entrained particles through a high temperature reactor. The particles pass through the reactor at such a flow rate that interparticle contact and coalescence are avoided but that at least the outer surfaces of the particles are melted. After melting, the particles fall through a distance sufficient to permit solidification and cooling prior to contact with a solid surface or each other.

Because the particles are melted while entrained in a carrier gas, the solidified particles are substantially spherical, have smooth surfaces and thus excellent flowability. In addition, the solidified particles have the same general size range as the starting material. However, depending on the porosity of the starting material, they may have a smaller mean particle size, due to densification during melting. Preferably the melting during densification is to such an extent that each particle becomes prealloyed, i.e., the metals (nickel and/or cobalt and/or iron) alloy together and achieve intimate contact with the densified carbide. Some solution of the constituents in one another may also take place. A major portion and preferably substantially all of the densified powder consists essentially of particles wherein each particle has a substantially uniform composition.

The plasma densification is preferably carried out in a plasma flame reactor. Details of the principles and operation of such plasma flame reactors are well known. The temperature within the plasma flame can be adjusted between 10,000° F. and 30,000° F. The temperature which the particles experience is a function of the rate at which they are fed through the reactor. Commercially available feeding devices allow rates between approximately ½ and 30 pounds per hour, depending on the bulk density of the material being fed. Conditions for plasma densification are established such that the particles reach a temperature at least above the melting point of the highest melting component and preferably below the vaporization point of the lowest vaporizing component.

The melted particles must be cooled at a rate sufficient to solidify at least an outer layer of the particles prior to their contact with a solid surface o with each other in order to maintain their sphericity and particle integrity. While any of several methods may be used to achieve this result, it has been found convenient to feed the melted particles into a liquid cooled chamber containing a gaseous atmosphere. The chamber may conveniently serve as a collection vessel.

After the powders have been plasma densified they can be classified to achieve the desired particle size distribution for use in plasma spray applications. Particle size distributions similar to those for the agglomerated and sintered particles are desired.

Alternatively, the plasma densified powders can be crushed and classified to yield a powder with a finer particle size distribution, preferably one for which all the particles pass through a 270-mesh U.S. screen and at least 60 percent of the particles are less than 20 microns in average diameter. A typical particle size distribution has less than 10 percent of the particles below about 5 microns. The bulk density is from about 5.5 to about 7.0 grams/cc.

EXAMPLE 1

A sintered agglomerated powder is prepared by blending nickel and iron powder, with a particle size less than approximately 10 micron with tungsten carbide (WC) powder of the same particle size in amounts sufficient to result in a blend comprising 12% of the nickel/iron and 88% tungsten carbide. The nickel/iron powder contains about a 1 to 1 ratio of nickel to iron by weight. A slurry is prepared by combining the resulting powder blend with polyvinyl alcohol in the ratio of 98:2 respectively, with enough water to make an 50–80% solids concentration. Spray drying is carried out by pumping the slurry at low pressure through a two fluid nozzle located at the top of a commercially available spray dryer. The slurry is continually agitated throughout the spray drying run. The atomization air pressure to the nozzle is 40–60 psi. The inlet air temperature is 370° C. with an outlet temperature of 140°–150° C. The spray dried powder is slowly passed through a hydrogen furnace at 450° C. to remove the organic binder. It is then fired for approximately 7 hours at 1000° C. to strengthen the agglomerated particles. The resulting particles are screened to yield powders with a −200 +325 or a −270 +20 μm particle size distribution. These particles can then be used as plasma spray powders.

EXAMPLE 2

The agglomerated spray dried and sintered particles of Example 1 are fed through a commercially available plasma torch into a jacketed water cooled collection tank. A mixture of 126 cubic feet per hour of argon and 70 cubic feet per hour of hydrogen is fed to the plasma torch. The torch power is about 28KVA. Nitrogen gas is fed to a powder feeder at the rate of 7 cubic feet per hour to entrain the powder which is fed through the torch. The powder produced is then screened as in Example 1. Analysis of the −270 powder indicated 15%–15 μm particles. These prealloyed powder particles can then be used as a plasma spray powder.

EXAMPLE 3

A plasma densified spray powder as produced in Example 2 is comminuted and air classified to produce a powder having the following distribution: 60–90% less than 20 μm, no more than 15% less than 5 microns.

EXAMPLE 4

A sintered agglomerate is prepared according to the process described in Example 1 by substituting a nickel-/iron powder containing a one to one weight ratio of nickel to iron and about 5% by weight cobalt. Similar results are obtained.

EXAMPLE 5

The sintered agglomerate powder of Example 4 is plasma densified according to the process as set forth in Example 2. The results were similar.

EXAMPLE 6

The densified plasma powder of Example 5 is comminuted and classified as in Example 3 with similar results.

I claim:

1. A plasma spray powder consisting essentially of metals selected from the group consisting of nickel, iron or cobalt, or mixtures and alloys thereof, with the balance being from about 50 to about 90 percent by weight tungsten and carbon, said tungsten and carbon being present in a one to one molar ratio and said iron and nickel being present in a weight ratio of at least about 4 parts by weight iron and nickel combined to 1 part by weight cobalt, said powder having a particle size distribution of about 60 to 90 percent minus 20 microns, and less than about 15 percent minus 5 microns and consisting essentially of homogeneous plasma densified and melt alloyed particles having a substantially uniform composition.

2. A plasma spray powder according to claim 1 having a particle size distribution of about 100 percent minus 270 mesh and less than 15 percent −15 microns.

3. A plasma spray powder according to claim 1 having a particle size distribution of about minus 200 plus 325 mesh.

4. A process for producing a plasma spray powder comprising preparing a uniform powder blend consisting essentially of metals selected from the group consisting of iron, nickel or cobalt being present in a weight ratio of at least 4 parts iron or nickel to 1 part cobalt with the balance of said powder being from about 50 to about 90 percent by weight tungsten and carbon, said tungsten and said carbon being present in a one to one molar ratio, said powder blend having an average particle size less than about 10 microns, agglomerating the powder to produce agglomerated particles, sintering the agglomerated particles, entraining the sintered agglomerated powder in a carrier gas, feeding the entrained agglomerated powder through a high temperature reactor having a temperature above the melting point of the highest melting component of the powder material to densify said particles, wherein said densified particles consist essentially of particles having substantially uniform composition, and comminuting and classifying said densified particles to produce a powder having a particle size distribution of about 60 to 90 percent minus 20 microns, and less than about 15 percent minus 5 microns.

5. A process for producing a plasma spray powder according to claim 4 wherein said densified particles have a particle size distribution of about 100 percent minus 270 mesh and less than 15 percent minus 15 microns.

6. A process for producing a plasma spray powder according to claim 4 wherein said uniform powder blend is spray dried to form said agglomerates.

* * * * *